United States Patent [19]

Atchisson

[11] 4,299,046

[45] Nov. 10, 1981

[54] SINGLE-SHOT SURVIVAL RIFLE

[76] Inventor: Maxwell G. Atchisson, 6695 Ridgemoore Dr., Doraville, Ga. 30360

[21] Appl. No.: 11,781

[22] Filed: Feb. 14, 1979

[51] Int. Cl.[3] ..... F41C 7/10

[52] U.S. Cl. ..... 42/75 D; 42/8; 42/40; 42/71 R

[58] Field of Search ..... 42/75 D, 40, 71 R, 1 R, 42/8, 44, 46

[56] References Cited

U.S. PATENT DOCUMENTS

| | | | |
|---|---|---|---|
| 47,755 | 5/1865 | Sneider | 42/8 |
| 60,698 | 1/1867 | Crispin | 42/8 |
| 419,412 | 1/1890 | Caldwell | 42/63 |
| 469,561 | 2/1892 | Haines | 42/8 |

*Primary Examiner*—Charles T. Jordan

*Attorney, Agent, or Firm*—Jones, Thomas & Askew

[57] ABSTRACT

A portable lightweight rifle which is primarily intended for use as a survival rifle. The rifle is readily disassembled into two assemblies for storage or ease of transporting, without requiring any separable fastener. A supply of ammunition is carried in a hollow stack tube. Both a rimfire embodiment and a centerfire embodiment are disclosed, and stampings or other relatively inexpensive and lightweight components are extensively used in both embodiments.

30 Claims, 22 Drawing Figures

94
96L
124L
105L
106L
88L
114L
113L
118L
119L
110L
85L
125L
123L
101
99
95
100
93
206
81
128L
146L
118C
114C
92
106C
98
97
105C
124C
150
83
113C
119C
110C
129L
130L
84L
125C
123C
128C
80
88R
106R
105R
96R
124R
85C
146C
118R
114R
125R
123R
128R
119R
113R
110R
85R
84C
129C
130C
146R
82
159
158
151
144
145
143
153
139
140
111
86
112
137
142
138
79
174
187
141
133
87
180
181
182
185
177
173
171
175
176
84R
129R
130R
78
168
161
172
157L
160
167
162
156L
164
156R
163
157R

SINGLE-SHOT SURVIVAL RIFLE

DESCRIPTION

1. Technical Field

This invention relates in general to firearms, and in particular to relatively small, lightweight rifles that are primarily intended for survival use in emergency situations.

2. Background of the Invention

The term "survival rifle" is commonly used in referring to a firearm which is primarily intended for use as a personal survival weapon in unforeseen or emergency situations. Persons such as campers, boaters, or flyers who travel through or over wilderness locations may not want to carry a conventional rifle due to its weight and size, but those persons may nonetheless want a weapon of greater accuracy than a handgun for hunting small game or for personal protection if they suddenly become stranded in the wilderness by a mishap such as a downed airplane or a broken vehicle. The ideal survival rifle should be relatively lightweight and compact, so as not to add significant weight to a backpacker and so as to conveniently fit within a pack, a small airplane, or in some other location not normally sized to receive a conventional rifle. A survival rifle should also be relatively inexpensive to manufacture, and should be capable of quick and easy assembly by the user without requiring tools or connective parts such as bolts that can easily become lost in the field. The survival rifle should also be capable of carrying a supply of ammunition.

Attempts have been made in the prior art to produce survival rifles which meet some of the foregoing criteria. Known examples of such prior art include the U.S. Air Force (USAF) M4 .22 Hornet bolt action rifle, the USAF M6 .22/.410 over/under survival rifle, the Armalite/Charter Arms AR-7 .22 semiautomatic survival rifle, and the Garcia "Bronco" single shot survival rifle with a skeleton stock. The foregoing guns are relatively large, expensive, heavy, complex, and slow to assemble, particularly in the context of possible assembly and use under adverse conditions where the user may be wearing mittens or gloves.

SUMMARY OF THE INVENTION

Stated in general terms, the present invention concerns a survival rifle which consists of two basic assemblies, a barrel assembly and a stock assembly. The two assemblies are quickly and easily interconnected or disconnected by a hinge joint which requires no separate fastening elements, and the assembled rifle breaks at this joint for loading rounds and ejecting spent shell casings. Stated somewhat more specifically, the rifle of the present invention has a hinge pin on one assembly which fits into an open slot on the other assembly to form the hinge joint, and the assembled rifle pivots about that hinge joint to provide a breech-loading action. A takedown latch normally prevents the breech action from opening to the extent required for taking down the rifle into its two separate assemblies. The survival rifle makes extensive use of sheet-metal parts that can be fabricated relatively inexpensively, and the stock assembly includes a hollow stock tube which functions as an ammunition magazine. The present survival rifle can be provided in either rimfire or centerfire configurations.

Accordingly, it is an object of the present invention to provide an improved survival rifle.

It is another object of the present invention to provide a single-shot survival rifle which is relatively compact and lightweight.

It is yet another object of the present invention to provide a single-shot survival rifle which is quick and easy to assemble.

It is still another object of the present invention to provide a survival rifle which is relatively inexpensive to manufacture.

Other objects and advantages of the present invention will become apparent from a review of the following detailed description of the disclosed embodiments and the appended drawings and claims.

DETAILED DESCRIPTION OF THE DISCLOSED EMBODIMENTS

Figure 1:
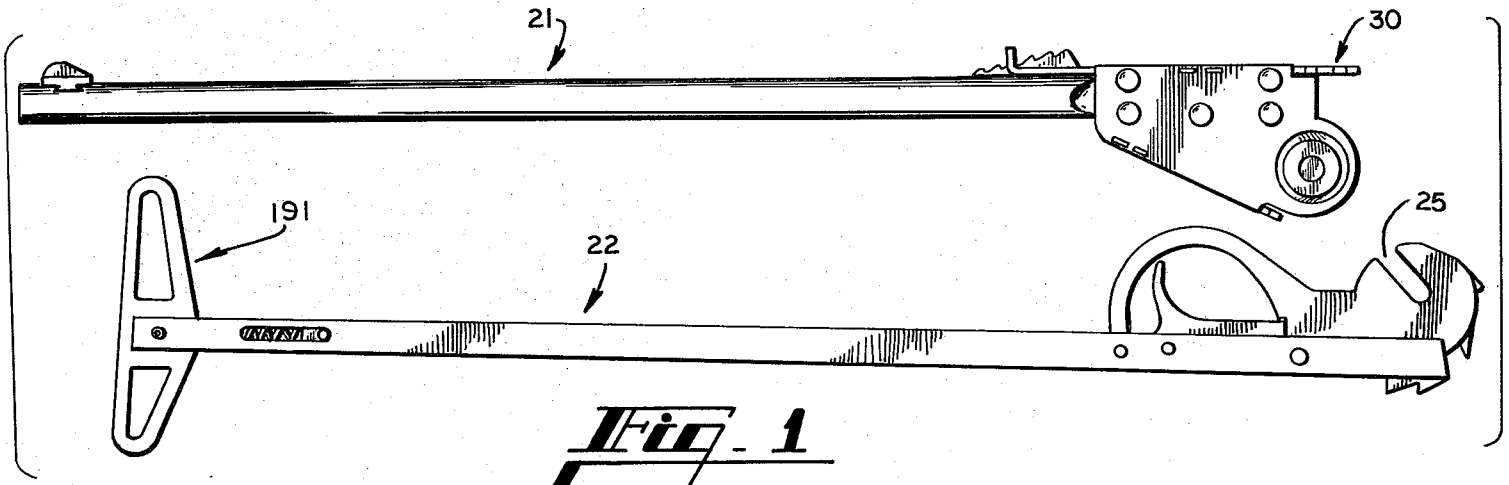
FIG. 1 is a pictorial view showing the two disassembled portions of a survival rifle according to a first disclosed embodiment of the present invention.

Two embodiments of the present survival rifle are disclosed and described herein, a rimfire embodiment shown in FIGS. 1-12 and a centerfire embodiment shown in FIGS. 13-22. The disclosed rimfire embodiment is chambered for the .22 long rifle cartridge, and the centerfire embodiment is chambered for the .30—30 Winchester cartridge, although it will be obvious to those skilled in the art that rifles according to the present invention can be constructed for other calibers such as .357 magnum, .223 Remington, and .410 shotgun ammunition. The rimfire embodiment is described first, and the centerfire embodiment is next described with emphasis on differences between it and the disclosed rimfire embodiment.

Turning initially to FIGS. 1-5, there is shown generally at 20 the disclosed rimfire embodiment of the present survival rifle, consisting of a barrel assembly 21 and a stock assembly 22 that are detachably interconnected at the hinge joint 23. The hinge joint 23 includes a hinge pin 24 in the barrel assembly 21 and best seen in FIGS. 6 and 8, and an open slot 25 contained in the stock assembly 22 and best seen in FIGS. 5, 8, and 9. Although a more detailed description of the hinge joint 23 is set forth below, the present description of the hinge joint is sufficient to understand the following general description of how the survival rifle 20 is assembled for loading and firing, and is taken down for disassembly.

It should be understood that the survival rifle 20, when not in use, will typically be broken down into the separate barrel assembly 21 and stock assembly 22 as shown in FIG. 1, and those two assemblies may be stowed in a suitable carrying case (not shown) or the like. When the survival rifle 20 is to be used, the barrel assembly 21 is aligned with the stock assembly 22 as shown in phantom in FIG. 5, so that the hinge pin slot 25 is aligned with the hinge pin 24. The barrel assembly and stock assembly are next moved together so that the stock assembly assumes the position shown in solid line in FIG. 5, with the hinge pin 24 seated at the closed end of the slot 25. The stock assembly is next rotated counterclockwise to the position seen in FIG. 4, where the takedown latch 28 engages a surface of the stock assembly to prevent the stock assembly from returning to the disassembly position shown in FIG. 5. The survival rifle 20 is now assembled and ready to be breech-loaded with a round of ammunition 29.

Figure 2:
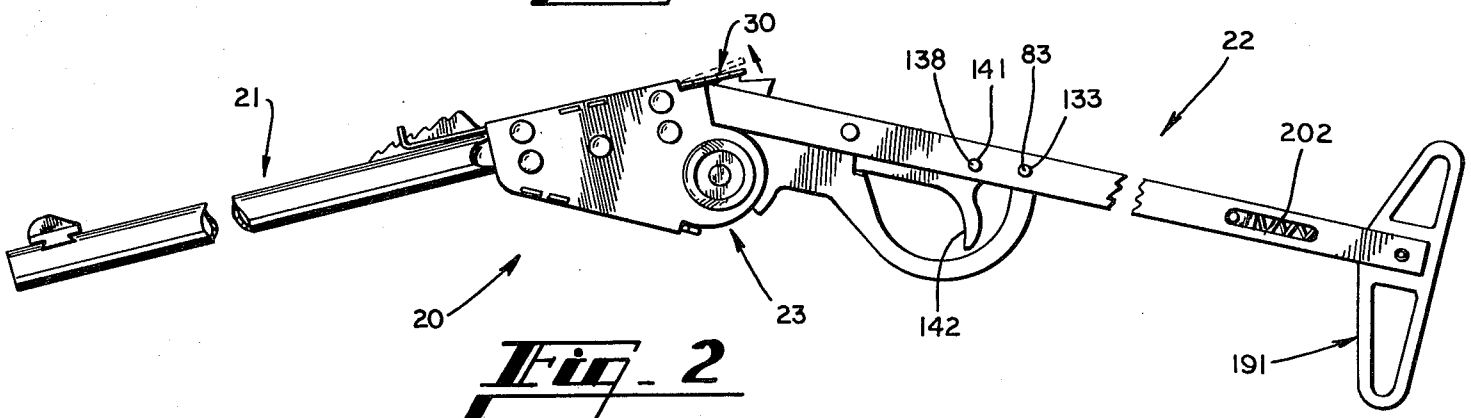
FIG. 2 shows the two components of FIG. 1 assembled to form a survival rifle, with the barrel and stock being broken for illustrative purposes.

Once the survival rifle 20 is loaded, the stock assembly is pivoted about the hinge joint 23 to assume the position shown in FIG. 2, with the breech-loading action closed and ready for firing. The latch 30 retains the action in the closed position shown in FIG. 2.

Figure 4:
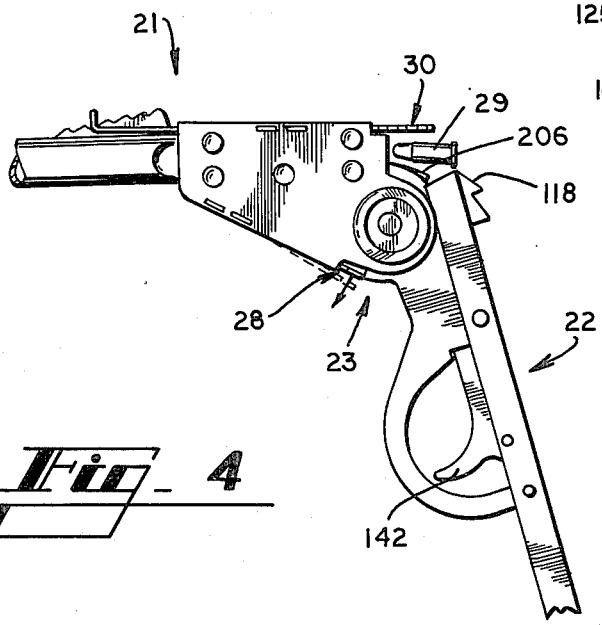
FIG. 4 is a fragmentary side view as in FIG. 3, showing the action broken to its fully-open position and showing a round in loading position.
Figure 5:
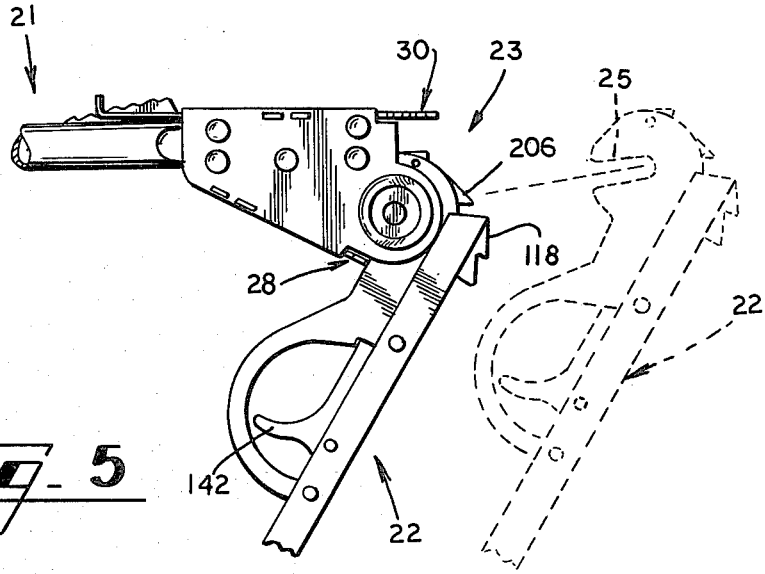
FIG. 5 is a partial side view of the embodiment shown in FIG. 1, showing the action opened beyond its fully-open position to facilitate taking down the rifle, and in phantom showing the stock assembly disconnected at the hinge joint.

When it is desired to take down the survival rifle 20, the foregoing procedure is reversed with the takedown latch 28 being manipulated as described below and as shown in phantom in FIG. 4 to permit the barrel assembly 21 and the stock assembly 22 to assume the disassembly position shown in FIG. 5. The hinge joint 23 is now disconnected simply by moving the stock assembly to the position shown in phantom, thereby withdrawing the hinge pin 24 from the slot 25.

Figure 6:
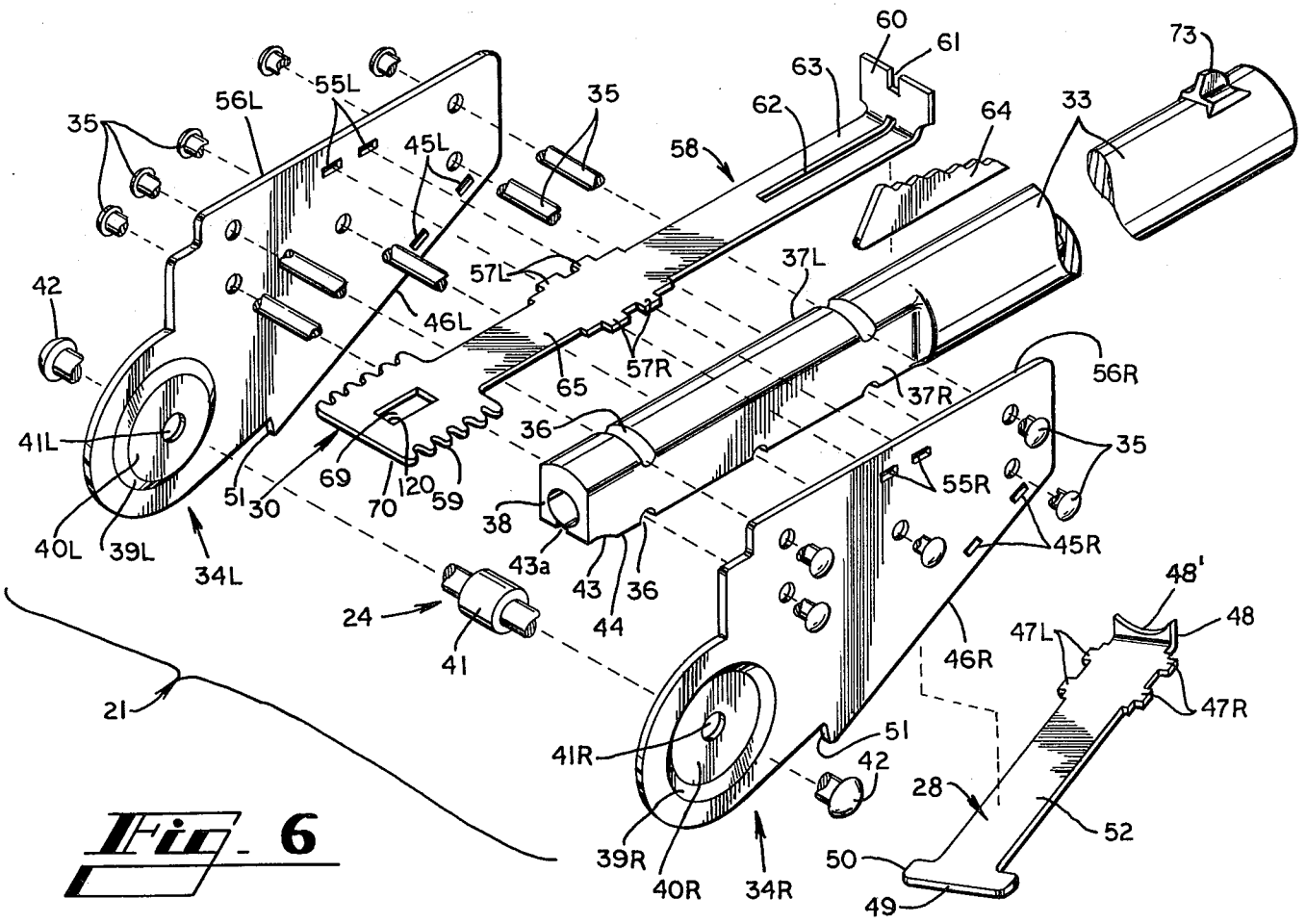
FIG. 6 shows an exploded view of the barrel assembly of the survival rifle shown in FIG. 1.

The two assemblies which make up the survival rifle 21 are now considered in detail, with reference first to the barrel assembly 21 as particularly shown in FIG. 6. The barrel assembly includes a barrel 33 which is retained at its rear or breech end between a right side plate 34R and a left side plate 34L. The side plates 34L and 34R form a permanent assembly with the barrel 33, and are interconnected by the several rivets 35 which extend through the side plates and through aligned rivet grooves 36 cut in the top and bottom exterior surface of the barrel 33. Flat surfaces 37L and 37R are machined into the exterior of the barrel 33 on opposite sides thereof, where the side plates 34L and 34R engage the barrel, so that the side plates firmly and rigidly engage the barrel in permanent assembly. The underside of the breech end 38 of the barrel 33 is formed in an arc 43, FIGS. 6 and 12, and a slot 43*a* extends upwardly into the arc portion in alignment with the bore of the barrel. The purpose of the arc 43 and the slot are discussed below.

Each of the side plates 34L and 34R has a region which is deformed or dished inwardly from the outer surface of the side plate, at a location disposed below the breech end 38 of the barrel 33. The deformed region for the right side plate 34R is shown at 39R on FIG. 6, and at 39L on FIGS. 6 and 12. The deformed regions 39R and 39L form a pair of opposed and parallel spaced-apart surfaces 40R and 40L, which confront each other in the space between the side plates; these confronting surfaces form part of the hinge joint 23, previously discussed.

A pair of coaxially aligned holes 41L and 41R are formed in the two deformed regions 39L and 39R, and the hinge pin 24 extends through those holes. The hinge pin 24 has a central portion 41 of enlarged diameter defining the spacing between the surfaces 40L and 40R, and which forms the hinging surface about which the hinge joint 23 is received. The hinge pin 24 is preferably permanently mounted through the deformed regions 39L and 39R of the side plates by way of peened ends 42.

Each of the side plates 34L and 34R has a pair of slots 45L, 45R formed adjacent the lower edges 46L, 46R of the side plates, and those slots accept the mating tabs 47L, 47R which project outwardly from the sides of the takedown catch 28. This takedown catch, which is retained between the side plates and thus forms part of the permanently-connected barrel assembly 21, is stamped or otherwise formed from sheet metal and has a forward end 48 which is bent upwardly from the plane of the takedown catch to fit against the underside of the barrel 33. A curved surface 48′ is formed at the end of the upturned portion 48, to accommodate the exterior surface of the barrel.

The other end of the takedown catch 28 terminates at a surface 49 which provides a stop for limiting the maximum opening of the survival rifle action, as previously discussed relative to FIG. 4 and as set forth below in further detail. The width of the takedown catch 28 adjacent the stop surface 49 is enlarged to form the finger tabs 50. These finger tabs of the takedown catch 28 fit behind the cut-away portions 51 of the two side plates 34L and 34R, and the lateral extent of the finger tabs is slightly greater than the thickness of the assembled side plates so that the finger tabs extend therefrom to permit manual grasping. It will be understood that the lateral width of the takedown catch 28, at the portion 52 located between the tabs 50 and the rearward tabs 47L and 47R, is slightly less than the corresponding dimension between the two side plates 34L and 34R, so that the takedown catch 28 is supported by the tabs 47 in cantilever fashion to be deformed downwardly when force is manually applied to the tabs 50.

Another group of slots 55L and 55R are also formed in the left side plate 34L and the right side plate 34R, respectively, adjacent the upper edges 56L and 56R thereof. These slots adjacent the upper edges of the side plates receive mating tabs 57L and 57R which project outwardly from the sides of the stamped member 58, which is thereby fixed between the side plates to form the top part of the permanent barrel assembly.

The plate 58 is laterally enlarged at its rear end to form the latch 30, previously described, and serrations 59 are formed along the sides of the enlarged portion to aid in manually grasping the latch.

The forward end of the plate 58 is upwardly turned at 60 and has an upwardly-facing notch 61 to provide an open sight of conventional design. A longitudinally-extending elevator slot 62 is formed in the forward portion 63 of the plate 58, extending backwardly from the upturned forward end 60, and a conventional elevator ramp 64 is received within the elevator slot 62 to provide elevation adjustment of the rear sight 61, in the conventional manner. The forward portion 63 of the plate 58, as well as the rearward portion 65 thereof which extends between the tabs 57 and the enlarged latch 30, have a lateral dimension slightly less than the spacing between the confronting inner surfaces of the side plates 34L and 34R, so that both the front end 60 and the latch 30 of the plate 58 can be manually elevated in opposition to the cantilever spring effect provided by that plate.

A locking recess 69 is formed in the latch 30 at a point between the serrated sides 59. The underside 70 of the latch 30 provides a camming surface which rides over the action latch 118 of the stock assembly 22, as described below, and the locking recess 69 engages that action latch to maintain the breech-loading action in closed and locked condition.

A front sight 73, which may be a standard type of sight, is fitted to the front end of the barrel 33 by any suitable technique, such as with a dovetail which meets with a transverse slot cut in the top of the barrel.

Figure 7:
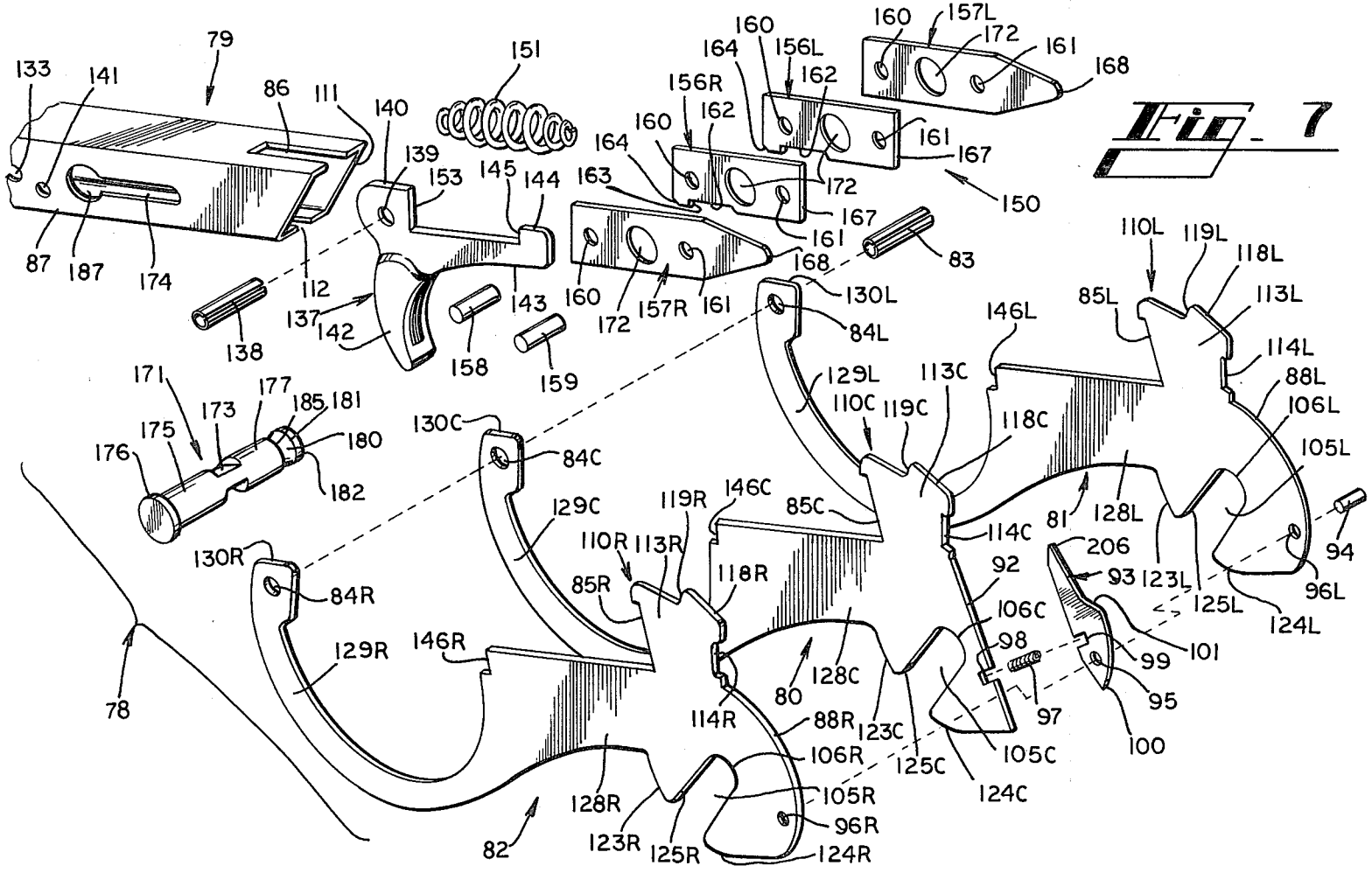
FIG. 7 shows an exploded partial view of the stock assembly of the rifle shown in FIG. 1.
Figure 8:
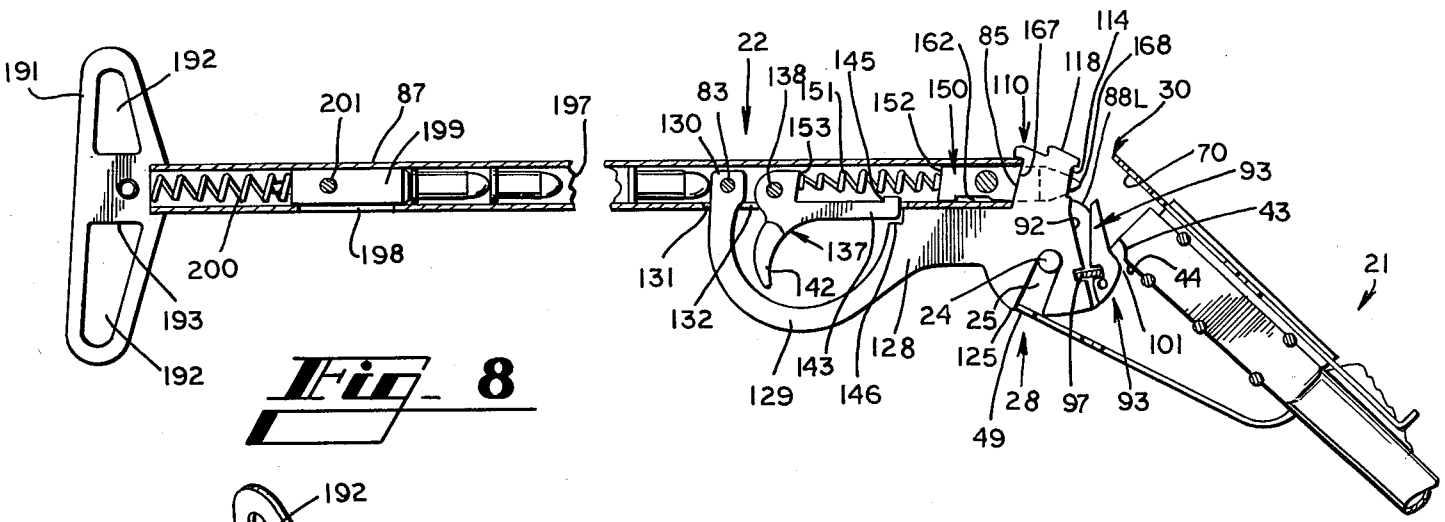
FIG. 8 shows a right-side elevation view of the rifle of FIG. 1 with the action fully open, and with the stock assembly sectioned and broken for illustrative purposes.

The stock assembly 22 is now described with particular reference to the exploded view shown in FIG. 7 and the sectional view shown in FIG. 8. For descriptive purposes the stock assembly 22 may be considered as comprising a receiver portion 78 and a stock portion 79, identified in FIG. 7, although it will become apparent that some overlap exists in the structure and function of those receiver and stock portions.

The receiver portion 78, as best seen in FIG. 7, is built up from a laminated assembly of three plates, being the center plate 80, the left outside plate 81, and the right outside plate 82. These three plates are normally sandwiched together and are held in assembly by a fastener such as a roll pin 83 which extends through the aligned openings 84L, 84C, 84R located at the back of the plates and through the opening 141 in the stock tube 87, and by the recesses 85L, 85C, and 85R which are formed at the top forward portions of the plates and which engage the slot 86 extending rearwardly from the top front end of the stock tube 87.

Each of the two outside receiver plates 81 and 82 may be identical in shape, and each of those receiver plates has at the forward end an arc 88L and 88R, respectively. The arcs 88L and 88R provide a clearance fit next to the arc 43, FIGS. 6 and 12, which is formed in the underside of the barrel 33 at its breech end 38, when the hinge joint 23 is interconnected. The corresponding front portion of the center plate 80 is cut away as shown at 92, FIG. 7, thus forming a recess for the extractor 93 between the two outside plates 81 and 82. The extractor 93, which is explained below in greater detail, is mounted in assembly within the receiver portion 78 by a pin 94 which extends through an opening 95 in the extractor member and is received in mating openings 96L and 96R in the left and right outside plates, respectively. An extractor spring 97 is captured between a forwardly facing recess 98 formed in the cut away portion 92 of the center plate 80, and a confronting rearwardly facing recess 99 formed in the back side of the extractor member. The extractor spring 97 urges the extractor member 93 to a forwardmost position determined by abutment of the extractor lower surface 100 with the confronting surface of portion 92 of the center plate. The forward surface 101 of the extractor member 93 projects slightly outwardly beyond the radii 88L and 88R of the two outside plates 81 and 82, and that surface 101 forms a camming surface which engages the radius 43 at the breech end of the barrel 33 to withdraw the extractor when the action of the survival rifle is broken open to a certain extent, as described below.

Respective slots 105L, 105C, and 105R are formed at the undersides of the forward ends of the left outside plate 81, the center plate 80, and the right outside plate 82. The slots 105L and 105R extend downwardly from closed upper ends 106L, 106R, which are substantially concentric with the radii 88L, 88R, to the open lower ends, and the slot 105C in the center plate 80 is identical in configuration to the other two slots. The slots 105 are mutually aligned when the three plates 81, 80, and 82 are sandwiched together in assembly, and the width of the slots is sufficient to receive the enlarged portion 41 of the hinge pin 24 on the barrel assembly 21.

It will now be appreciated that the outside surfaces of the left and right plates 81 and 82 freely fit within the surfaces 40L and 40R of the barrel assembly side plates 34L and 34R. These mutually confronting surfaces 40L and 40R, along with the hinge pin 24 and the aligned slots 105 of the assembled plates which make up the receiver portion 78, comprise the hinge joint 23. It will also be apparent that the angular orientation of the aligned slots 105 determines the relative angular position of the barrel assembly 21 and the stock assembly 22 at which the survival rifle can be assembled or disassembled, as previously described with reference to FIG. 5.

The center plate 80 and the outside plates 81 and 82 each have an upstanding portion 110C, 110L, and 110R, respectively, located at the forward ends of the plates at a location generally above and in back of the arcs 88L and 88R. The upstanding portions 110 include rearwardly facing surfaces which define the recesses 85, previously mentioned, that retain the forward end 111 of the stock tube 87, and it will be seen that the surfaces which make up the recess 85 also serve to stop forward movement of the hammer assembly. The stock tube 87, which is a hollow tubular member of square cross-section in the disclosed embodiment, has slots 86 and 112 extending inwardly from the upper and lower surfaces of the forward end 111, and those slots accommodate the area 113L, 113C, 113R of the upstanding portions 110 in front of the recess 85.

Forwardly facing cartridge rim recesses 114L, 114C, 114R are formed in the front faces of the upstanding portions 110, and the thickness of the assembled plates is chosen so that the lateral width of the combined rim recesses 114 of the three sandwiched plates is slightly less than the diameter of the rimfire cartridge for which the survival rifle 20 is chambered. The rim of the cartridge thus overlaps the assembled rim recess 114 on each side thereof, for exposure to the firing pins as described below. It will be seen from FIG. 9 that the assembled receiver portion 78 is mounted within the stock tube 87 so that the rim recess 114 is slightly recessed inwardly behind the forward end 111 of the stock tube.

Figure 3:
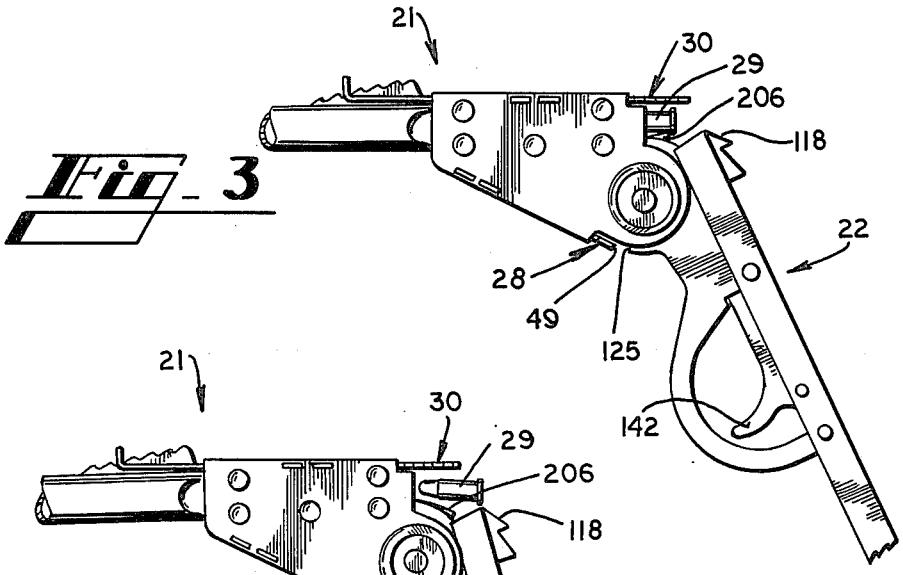
FIG. 3 shows a fragmentary side view of the assembled rifle of FIG. 2, showing the action broken short of the fully-open position and showing a partially extracted cartridge.

The surfaces 118L, 118C, 118R facing upwardly from the tops of the corresponding upstanding portions 110 slope forwardly to define the cam surface 118 for the latch 30 of the barrel assembly 21, as best seen in FIGS. 3 and 8. When the action of the survival rifle 20 is moved toward the closed position shown in FIG. 2, the underside 70 of the latch 30 contacts the cam surface 118 and moves along that surface until the locking recess 69 formed in the latch 30 is positioned over the cam surface 118. The size of the combined cam surfaces 118L, 118C, 118R, when the receiver portion 78 is connected in assembly, is slightly less than the size of the recess 69 in the latch 30, so that the rearward portion 65 of that latch deflects downwardly to lock the cam surface 118 within the locking recess. Extending downwardly from the back of each cam surface 118 are the locking surfaces 119L, 119C, 119R, which engage the back edge 120 of the locking recess 69 so as to lock the action of the rifle in the closed position shown in FIG. 2. When it is desired to open the action, the serrated sides 59 of the latch 30 are manually grasped between thumb and forefinger and the latch is raised sufficiently to clear the locking surface 119 of the upstanding portion 110.

Considering again the forward ends and the slots 105 in each of the three plates 80, 81, and 82, it is seen that the radii of the locations 123L, 123C, 123R immediately behind the slot open ends, measured with respect to the center of the slot closed ends 106, is slightly greater than the corresponding radii of the points 124L, 124C, 124R immediately in front of the slot open ends. This slightly greater radius behind the open end of each slot 105 defines the stop surfaces 125L, 125C, 125R at the rear of the slot open end, and those stop surfaces 125 engage the stop surface 49 of the action takedown catch 28 as best shown in FIGS. 3 and 8. The takedown catch can be released for disassembling the survival rifle by manually grasping the tabs 50 on the takedown catch and deflecting the stop surface 49 downwardly to clear the stop surface 125.

Each of the plates 80, 81, and 82 has a central portion 128C, 128L, and 128R, respectively, which extends rearwardly from the stock tube recess 85, and which fits beneath and in contact with the underside of the stock tube 87 in assembly. The plates 80, 81, and 82 extend rearwardly and downwardly from their central portions 128 to form trigger guard portions 129C, 129L, 129R. The back end of each trigger guard portion curves upwardly to terminate at the ends 130L, 130C, 130R which extend through the enlarged rearward end 131 of the slot 132 formed in the underside of the stock tube 87. As previously mentioned, the roll pin 83 extends through openings 84 at the ends 130 of the trigger guard portion and through mating openings 133 in the sides of the stock tube 87 to secure the ends 130 in place within the stock tube. It will thus be understood that the receiver portion 78 comprised by the center plate 80, the left outside plate 81, and the right outside plate 82 is retained in assembly within the stock tube by the roll pin 83 and also by the recess 85 which fits within the slots 86 and 112 in the forward end of the stock tube.

A trigger member 137 is supported within the trigger guard 129 by the roll pin 138 which extends through the opening 139 in the upper end 140 of the trigger member, and through the aligned openings 141 in the sides of the stock tube 87. The trigger member 137 includes the trigger 142 that extends downwardly through the slot 132 in the underside of the stock tube, and also includes the portion 143 which extends forwardly within the slot 132 to terminate at the upwardly projecting member 144 which extends a distance upwardly into the hollow interior of the stock tube. A vertical surface 145 at the rear of the upwardly projecting member 144 provides the sear engaging surface for engaging the hammer. Notches 146L, 146C, 146R are provided in the respective plates 81, 80, and 82 at the forward ends of the trigger guard portions 129 to accommodate the forward portion 143, and the lower edges of the notches limit the downward movement of the forward portion 143 and thus limit the extent of trigger pull, as is best shown in FIG. 8.

Figure 10:
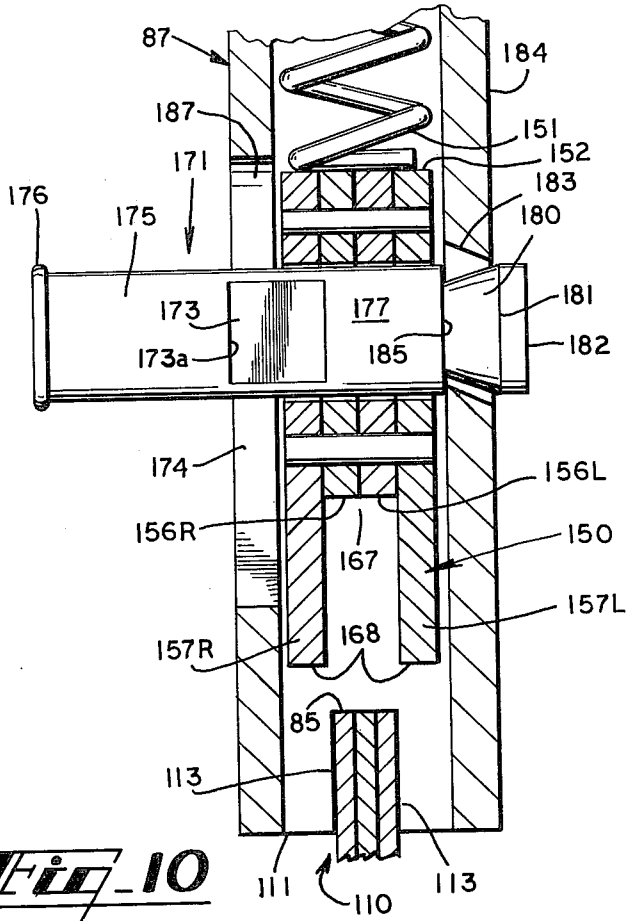
FIG. 10 is a section view taken along line 10—10 of FIG. 9, with the bolt cocked and showing details of the hammer-firing pin assembly and the safety mechanism.

The hammer assembly 150, best seen in FIGS. 8 and 10 and in exploded view in FIG. 7, fits within the interior of the stock tube 87 in front of the trigger member 137. A compression spring 151 is disposed between the forwardly facing surface 153 of the trigger member, located in front of the trigger pivot opening 139 and above the forward portion 143, and the back 152 of the hammer assembly 150. The spring 151 urges the hammer assembly 150 to its forwardmost position as shown in FIG. 8, and simultaneously urges the trigger member 137 in a counterclockwise direction as viewed in that Figure; the spring 151 thus functions both as a hammer spring and as a trigger spring. The forward surface 153 on the trigger member 137 is angled forwardly from vertical, as viewed in FIGS. 7 and 8, so that force of the spring 151 provides the aforementioned counterclockwise force to the trigger member, and also to assist in retaining the spring in place while the trigger member, the spring, and the hammer assembly 150 are being assembled within the stock tube 87 to form the stock assembly 22.

Referring to the exploded view shown in FIG. 7, it is seen that the hammer assembly 150 is built up from a pair of identical sear plates 156L and 156R, and a pair of firing plates 157L, 157R which flank the sear plates. The four plates which make up the hammer assembly 150 are pinned together by a pair of pins 158 and 159 which fit through aligned series of openings 160 and 161, respectively, in the four plates. The plates which make up the hammer assembly 150 could alternatively be welded together, or the hammer assembly could be a one-piece machined part.

A notch 162 is formed in the underside of each sear plate 156L and 156R, and the back surfaces 163 of those notches define the sear surface of the hammer assembly. The lower back edge 164 of each sear plate 156 is chamfered or otherwise broken away.

Each of the firing plates 157L and 157R extends forwardly a distance beyond the front faces 167 of the sear plates 156, and the forward end of each firing plate converges to an edge 168. The edges 168 of the firing plates extend in front of the surfaces 167 of the sear plates and are vertically located about mid-height of the hammer assembly 150.

Referring to FIGS. 8 and 10, it is seen that the front faces 167 of the sear plates form a surface which contacts the recess 85 defined on the plates 80, 81, 82 at the back side of the upstanding portion 110, so that forward movement of the hammer assembly by the spring 151 is limited by contact between the surfaces 167 and 85. The firing plates 157 of the hammer assembly pass along the side areas 113 of the upstanding portion 110 as the hammer assembly travels home to its fully forward position, at which position the edges 168 protrude on both sides of the rim recess 114. Thus, the edges 168 of the firing plates form double rimfire firing pins.

A charging handle 171, best seen in FIGS. 7 and 10, slidably extends through the aligned transverse openings 172 in the sear plates and firing plates which make up the hammer assembly 150. The charging handle 171 is a cylindrical member having a pair of flat surfaces 173 on opposed sides, where the charging handle extends through the slot 174 in the right side of the stock tube 87. The dimension between the flat surfaces 173 of the charging handle permit sliding longitudinal movement of the charging handle within the slot 174, and also permit the charging handle to be moved transversely within the slot as pointed out below. The charging handle 171 has a shank 175 which extends outwardly from the slot 174, and which terminates at a rounded knob 176 at the outer end of the charging handle.

The charging handle 171 includes a hammer assembly engaging surface 177 which slidably fits within the opening 172 through the hammer assembly 150, and the charging handle terminates with the tapered surface 180, which tapers from a maximum diameter at the circumferential location 181, spaced inwardly a short distance from the end 182 of the charging handle, to the point 185 of minimum diameter which is contiguous to the hammer engaging surface 177. The end 182 and the tapered surface 180 of the charging handle 171 are aligned with the angled opening 183 in the left side 184 of the stock tube 87, when the bolt assembly 150 is at maximum rearward travel within the stock tube, and the flat surfaces 173 extending through the slot 174 in the stock tube permit sufficient lateral movement of the charging handle to selectively insert or to withdraw the tapered surface 181 from the hole 183. As best seen in FIG. 10, the hole 183 in the stock tube side 184 is raked backwardly at an angle which is approximately the same as the taper angle of the tapered surface 180 at the end of the charging handle 171, so that the surface of the opening 183 engages the forward side of the tapered surface 180 to inhibit accidental or inadvertent withdrawal of the charging handle 175 from safety position.

Figure 9:
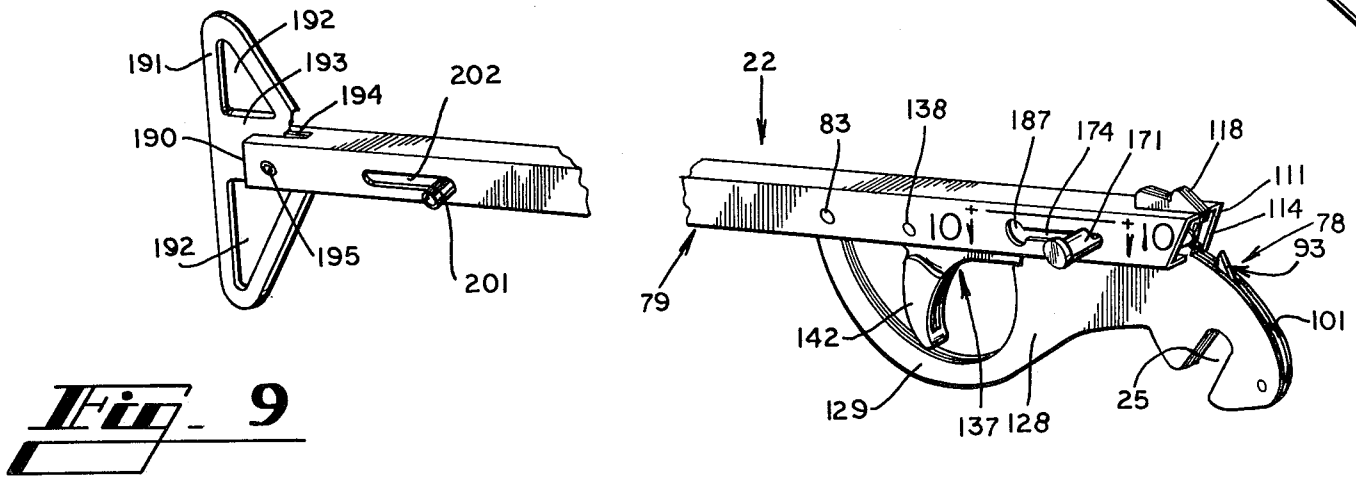
FIG. 9 is a broken pictorial view showing the stock assembly of the rifle in FIG. 1.
Figure 11:
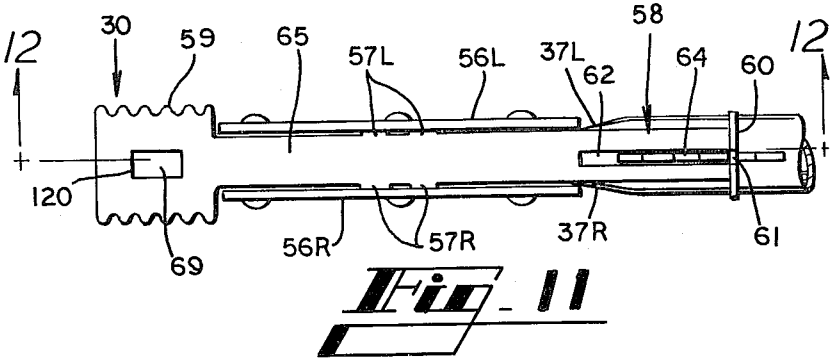
FIG. 11 is a fragmentary top plan view of the barrel assembly, showing details of the action latch.
Figure 12:
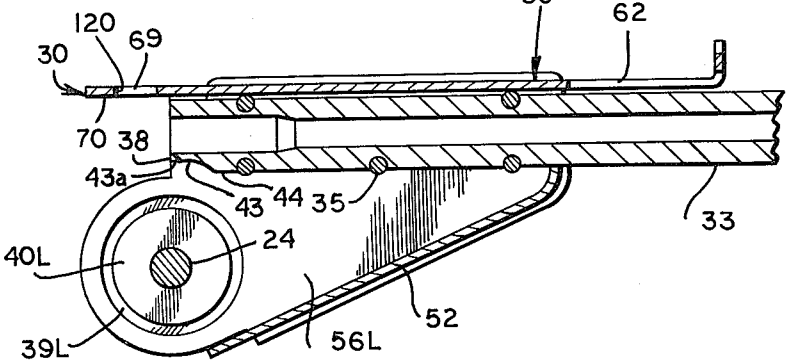
FIG. 12 is a sectioned right-side elevation view of the barrel assembly fragment shown in FIG. 11.

An enlarged opening 187, FIG. 9, joins the rear end of the slot 174 in the right side of the stock tube 87. The charging handle 171 is inserted through the enlarged hole 187 and thence through the opening 172 in the hammer assembly 150, during assembly of the receiver portion 78 with the stock tube 79. The hammer assembly and charging handle are then slid to the full-forward position, after which the spring 151 and the trigger member 137 are installed as aforementioned, whereupon the hammer assembly and the charging handle are retained in assembly within the stock tube 87.

The stock tube 87 extends rearwardly from the receiver portion 78 to terminate at the back end 190, and the butt plate 191 is attached to the back end of the stock tube. The butt plate 191 may be stamped from sheet metal, and is shown with portions 192 cut away to lighten the survival rifle. The butt plate 191 has a solid central portion 193 which fits within a vertical slot 194 extending inwardly from the end 190 of the stock tube. A roll pin 195 extends through a hole in the butt plate end through mating holes in the sides of the stock tube, to secure together the butt plate and the stock tube.

The hollow interior of the stock tube extending rearwardly of the trigger guard end 130 provides a cartridge magazine 197, and nine rounds of .22 long rifle ammunition can be stored within the magazine of an actual embodiment of a rimfire survival rifle according to the present invention. Access to the magazine 197 is provided through the loading slot 198 formed in the underside of the stock tube 87, and the slot is normally kept closed by a gate member 199 which is slidably received within the stock tube and is biased forwardly by the compression spring 200. The gate 199 can be opened by manipulating the gate pin 201 which fits through a lateral hole in the gate, and which extends through slots 202 extending along both sides of the stock tube 87. The loading slot 198 is preferably only slightly longer than a round of ammunition for which the survival rifle is chambered, so that ammunition can be removed from the magazine one round at a time while wearing gloves or the like.

The operation of the survival rifle 20 is now briefly described, although that operation may be apparent from the foregoing detailed description. Once the rifle has been assembled by interconnecting the hinge joint 23, a round of ammunition is withdrawn from the magazine 197 and is loaded in the open breech, as indicated at 29 in FIG. 4. The action of the survival rifle is then closed and locked by latch 30, after which the rifle is cocked by pulling back the charging handle 171 until the sear engaging surface 145 of the hammer member engages the sear surface 163 of the hammer assembly. The rifle is now ready to fire. The safety can be engaged by sliding the knob end 176 of the charging handle 171 inwardly toward the stock tube, so that the surface 177 slides through the hammer assembly until the tapered surface 180 at the other end of the charging handle moves into the angled opening 183 in the wall of the stock tube. The opening 183 is preferably located so that the bolt assembly 150 must be retracted a short distance behind sear position in order to slide the charging handle inwardly to engage the safety. Inward movement of the charging handle 171 is limited by abutment of the radial surface 173*a*, where the flat surfaces 173 meet the outer end of the charging handle, against the outside of the stock tube 87. The end 182 of the charging handle extends outwardly from the left side 184 of the stock tube at this time, as seen in FIG. 10, providing both a visual and a tactile indication that the survival rifle is on safety. The bolt assembly is locked against forward movement at this time. The survival rifle is taken off safety by sliding the charging handle in the opposite direction until the end 182 of the charging handle is withdrawn from the opening 183 in the stock tube wall.

After the survival rifle 20 has been fired, the action latch 30 can be opened and the action broken open. As seen in FIG. 3, the upper end 206 of the extractor member 93 engages the rim of the spent cartridge casing to partially extract that cartridge casing from the barrel. As the action is broken to its fully-open position shown in FIG. 4, the camming surface 101 of the extractor member contacts the surface 44 on the underside of the barrel, located immediately in front of the arc 43, so that the upper end 206 of the extractor is withdrawn downwardly toward the arc 88 of the outside plates 81 and 82 which comprise the receiver portion 78. This withdrawing of the upper end 206 enables the next round to be loaded without obstruction by the extractor. When the action is closed, the extractor member 93 is moved backwardly by contacting the breech end 38 of the barrel; the slot 43*a* accommodates the upper end 206 of the extractor when the action is closed.

The disclosed centerfire embodiment of the present survival rifle is now described, and primed numerals are used in the following description for referring to assemblies or components that are like those of the rimfire embodiment previously described. The centerfire embodiment is described in the context of features which differ from the rimfire embodiment, and it should be understood that other features which may be essentially unchanged from the rimfire embodiment are not detailed in the following description.

Figure 16:
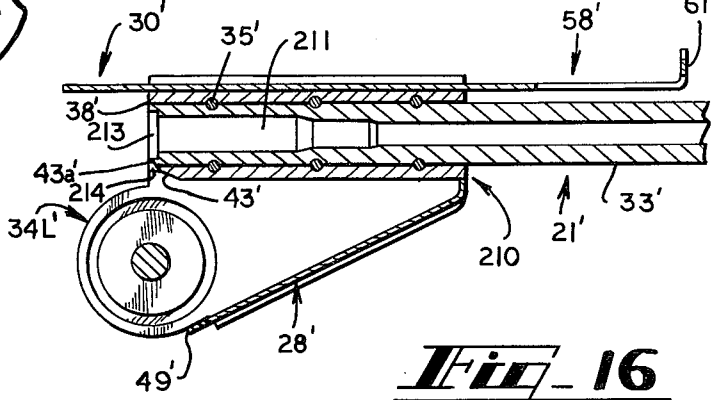
FIG. 16 is a sectioned right-side elevation view of the barrel assembly fragment shown in FIG. 15.
Figure 17:
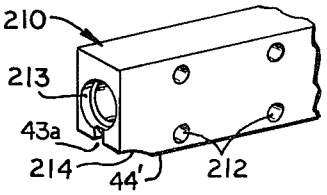
FIG. 17 is a pictorial view of the barrel block shown in FIG. 16.
Figure 15:
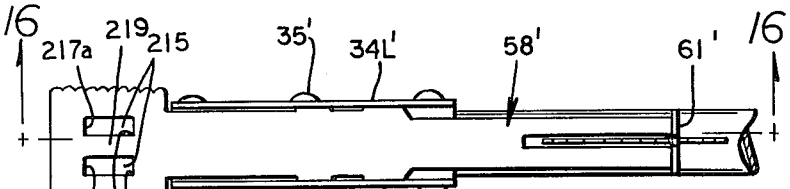
FIG. 15 is a fragmentary top plan view of the barrel assembly for the second embodiment showing details of the action latch.

Turning first to FIGS. 15 and 16, there is seen the barrel assembly 21' including the barrel 33' having its breech end secured in assembly between a pair of side plates 34L' and 34R'. A plate 58' is positioned above the barrel 33' at its breech end and is secured in assembly between the two side plates. This plate 58' provides the functions of a rear sight 61' and of the action latch 30', although it will be seen that the construction of the action latch is somewhat different from that of the embodiment described above. A takedown latch plate 28' below the barrel 33' is also secured in place between the two side plates 34L' and 34R', and the rear surface 49' of the takedown latch provides a stop surface which limits the maximum extent to which the action of the rifle can break open.

The barrel assembly 21' of the disclosed centerfire embodiment differs from the rimfire embodiment with the inclusion of the barrel block 210 which surrounds the breech end 38' of the barrel 33'. The barrel block 210, FIG. 16, has a rectangular external shape, and the side plates 34L' and 34R' are secured in assembly against the respective lateral sides of the block; the barrel block extends longitudinally along the barrel preferably for at least the extent of the cartridge-receiving chamber 211. Since centerfire embodiments of the rifle are typically chambered for cartridges that are more powerful than rimfire cartridges, the barrel block 210 in closely surrounding relation to the breech end of the barrel 33' provides increased strength necessary to withstand the relatively high gas pressure within the breech end of the barrel, without resort to relatively expensive alternatives such as a tapered barrel or a barrel which is thicker (and therefore heavier to carry) along its entire length.

The barrel block 210 is maintained in assembly with the barrel 33' and the side plates 34L' and 34R' by a number of rivets 35' which extend through lateral openings 212 in the barrel block and which partly extend across the barrel-receiving opening 213 through the barrel block. The rivets 35' also engage corresponding lateral notches in the exterior surface of the barrel 33', as shown in FIG. 16, thereby maintaining the barrel and the barrel block 210 in assembly along with other elements of the barrel assembly 21'.

The barrel 33' has an arc 43' cut in the underside of the breech end 38' of the barrel so as to mate with the arc 88 (FIG. 18) at the front of the receiver portion 78; and the barrel block 210 has an arc 214 machined in its underside to align with the arc 43'. The arc 43' of the barrel and the arc 214 of the barrel block provide a clearance fit with the arc 88 on the receiver portion, in the same manner as previously in the same manner as previously described with respect to the rimfire embodiment. The camming surface 101' on the extractor 93' contacts the surface 44' on the underside of the barrel block to withdraw the extractor, and the slot 43*a'* is provided at the back of the barrel block to receive the extractor upper end 206' when the action is closed.

Turning to FIG. 15, it is seen that the action latch 30' at the back end of the plate 58' has a pair of locking recesses 215 laterally spaced on the plate and extending therethrough. These locking recesses 215 mate with a corresponding pair of locking surfaces 216 on the stock assembly 22' of the centerfire embodiment. The use of a pair of locking recesses 215 in the action latch 30 provides a latch which is stronger than the single-opening latch described above for the rimfire embodiment, inasmuch as the locking force is distributed across two locking surfaces 217*a* and 217*b*. Although the combined extent of the surfaces 217*a* and 217*b* could ostensibly be obtained with a single locking opening 215 in the action latch 30', the use of the two locking openings also doubles the number of corners 218 at which stress concentration can occur. The use of two locking openings 215 thus reduces the amount of stress which is applied to each corner 218 of an opening, and also provides the central portion 219 between the locking openings to provide additional strength to the action latch 30'. Accordingly, the increased requirements of the action latch for the heavier and more powerful centerfire rifle can still be met by a plate 58' which is stamped from sheet metal that is sufficiently thin to have the spring effect desirable both for the action latch and for the rear sight 61', as discussed above.

Figure 13:
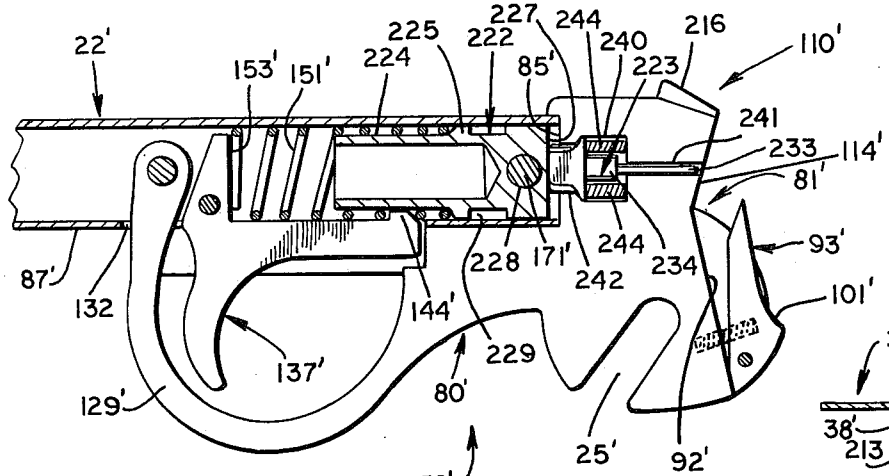
FIG. 13 is a sectioned right-side elevation view showing the stock assembly of a survival rifle according to a second disclosed embodiment of the present invention.
Figure 18:
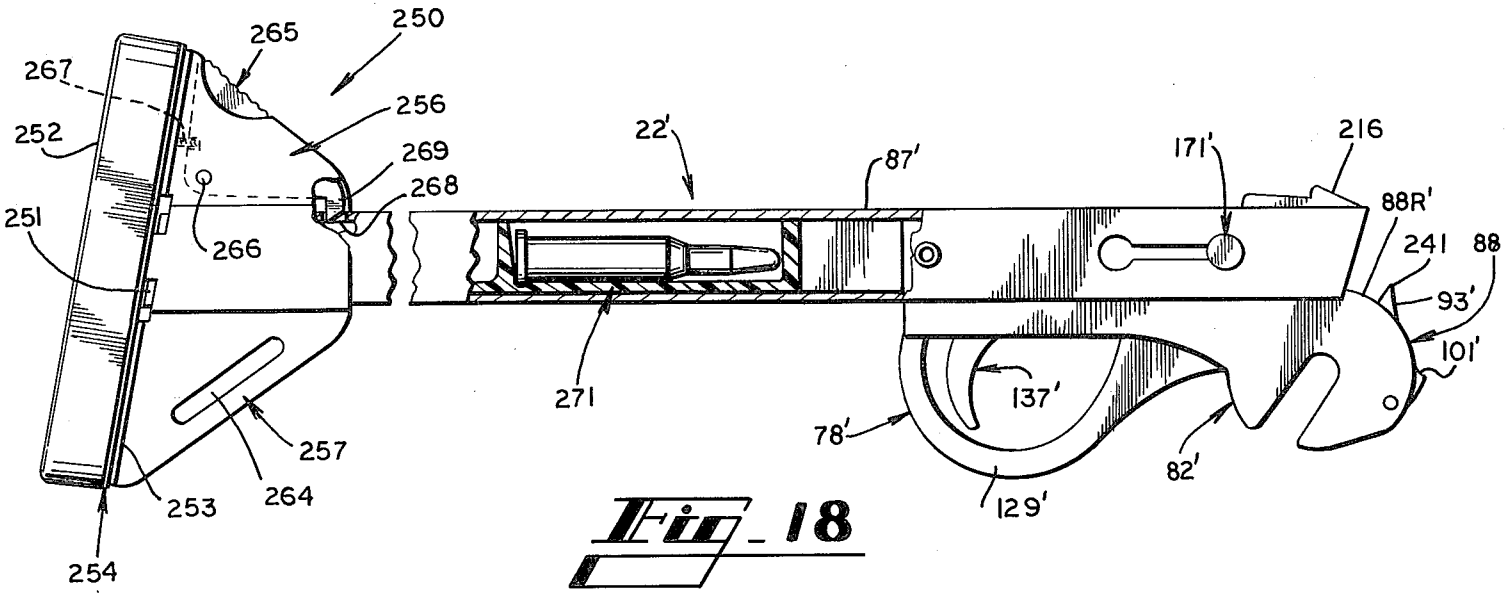
FIG. 18 is partially sectioned and broken right-side elevation view of the stock assembly for the second embodiment.
Figure 20:
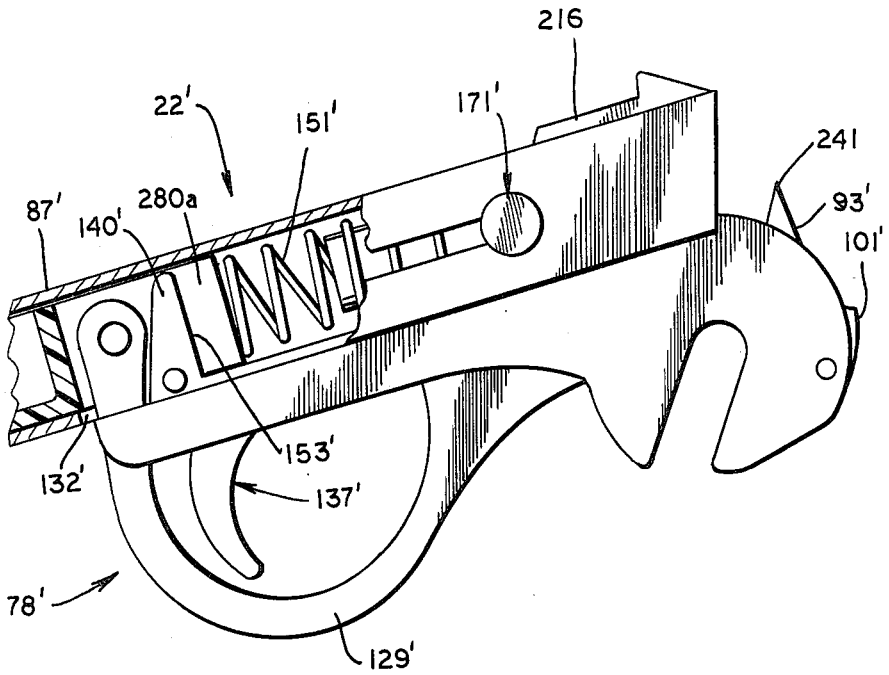
FIG. 20 is a fragmentary and partially sectioned right-side elevation view of the stock assembly for the second embodiment, showing the hammer spring compressed for installation of the receiver assembly.

Turning next to the stock assembly 22' of the centerfire embodiment, as shown in FIGS. 13, 18, and 20, there is a receiver portion 78' that is built up of a center plate 80' sandwiched between two outside plates in a manner substantially similar to that of the rimfire embodiment. Only the center plate 80' and the left outside plate 81' are shown in FIG. 13, and the right outside plate 82' is shown in FIG. 18. The extractor member 93' is pivotably mounted within the space provided by the cutaway portion 92' at the forward end of the center plate 80', and the extractor member has a forward camming surface 101' which engages the breech end of the barrel 33' to retract the extractor during opening of the action, all as previously described. Because the center plate 80' and the extractor member 93' are thicker than the corresponding parts of the disclosed rimfire embodiment, the extractor spring 97' is received in holes drilled in the center plate and the extractor member.

It is desirable with the centerfire embodiment to have a hammer 222 that is separate from the firing pin 223, unlike the combined hammer-firing pin assembly 150 of the rimfire embodiment. The hammer 222, as seen in FIG. 13, is a machined cylindrical member which fits for sliding movement within the open forward end of the stock tube 87'. The hammer 222 is biased forwardly by the compression spring 151', which fits about the rear shank portion 224 of the hammer and engages the flange 225 which surrounds the hammer slightly forwardly of its longitudinal midpoint. Forward movement of the hammer 222 is stopped by the recessed surface 85' of the receiver portion 78', into which the forward end of the stock tube 87' fits.

The hammer 222 has a forward end with a front surface 227 which actually contacts the firing pin 223, and a transverse opening 228 extends through the forward end of the hammer to receive the charging handle 171'. The charging handle 171' is laterally slidable within the hammer, and when cocked mates with an opening (unshown) in the left side of the stock tube 87' to provide a safety, in the manner described with respect to the rimfire embodiment. A notch 229 is formed in the underside of the hammer 222 to receive the upwardly projecting member 144' of the trigger member 137', when the hammer is pulled back by the charging handle to cocked position. It will be seen that the spring 151' functions both as a hammer spring and as a trigger spring, although the diameter of the spring is large enough to permit the forward surface 153' of the trigger member 137 to be vertical rather than forwardly-angled as in the rimfire embodiment.

Figure 14:
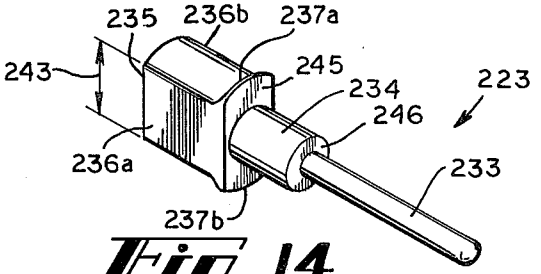
FIG. 14 is a pictorial view showing the firing pin of the embodiment depicted in FIG. 13.

The firing pin 223, FIG. 14, includes a pin member 233 which extends forwardly from a body 234 of somewhat enlarged diamter relative to the pin member. Extending rearwardly from the body 234 of the firing pin is a retaining member 235 which, unlike the pin member 233 and the body 234, is noncircular and is generally elongate in the vertical dimension. Retaining member 235 has a pair of laterally spaced-apart flat surfaces **236*a* and 236*b*, and the thickness of the retaining member defined by those flat surfaces is slightly less than the thickness of the center plate 80' which forms part of the receiver portion 78'. The top and bottom of the retaining member 235 have projecting portions with rearwardly-facing arcuate surfaces as shown at 237*a* and 237*b***.

Returning to FIG. 13, it is seen that the center plate 80' is formed with a firing pin recess 240 in the upper portion 110' intermediate the recess 85' and the forwardly-facing surface 114' which abuts the rim of the cartridge to be fired. The surface 114' is a flat surface in the disclosed centerfire embodiment, and the surface is defined by portions of the center plate 80' and the two outside plates of which the receiver portion is fabricated. The height of the recess 240 is sufficient to receive the retaining member 235 of the firing pin 223 in the vertical or full-upright position, and an opening 241 extends forwardly through the upstanding portion 110' from the firing pin recess 240 to the rim abutting surface 114. The pin member 233 of the firing pin extends through the opening 241, and it will be understood that the forward terminus of the opening 241 is aligned with the primer of the centerfire cartridge for which the rifle is chambered.

Extending rearwardly from the firing pin recess 240 to the recess 85' is the passage 242, whose vertical extent is slightly greater than the vertical dimension 243 (FIG. 14) of the firing pin retaining member but is less than the corresponding vertical dimension between the top portion **237*a* and bottom portion 237*b* of the firing pin. In assembling the receiver portion 78', the firing pin 223 is inserted in the center plate 80' before either of the outside receiver plates are assembled. The firing pin is rotated axially so that the top 237*a* and bottom 237*b* of the retaining member 235 clear the sides of the passage 242, and the firing pin is then moved forwardly into the recess 240 while the pin member 233 enters the opening 241. The firing pin is rotated to the full-vertical position when the top portion 237*a* and bottom portion 237*b* of the retaining member 235 are within the recess 240, and the two firing pin springs 244 are positioned between the front wall of the recess and the forwardly-facing surface 245 of the firing pin. The receiver portion center plate 80', with the firing pin thus in place, is now mounted in assembly with the left and right outside receiver plates, and it will be understood that the firing pin 223 and its springs 244 are slidably retained in place within the recess 240 since the two outside plates prevent the firing pin from rotating sufficiently to allow the portions 237*a* and 237*b* to clear the walls of the passage 242** in the center plate.

The forwardly-facing vertical surface 246 of the firing pin 223, where the back end of the pin member 233 joins the body 234, provides a stop surface which limits forward movement of the firing pin when struck by the hammer 222. A blow on the firing pin 223 by the hammer 222 thus moves the firing pin and its pin member 241 forwardly to an extent which ignites the primer of the cartridge, and the stop surface 246 prevents excessive forward movement which might rupture the primer. The firing pin springs 244 return the firing pin to its rest position after the hammer 222 falls.

Figure 21:
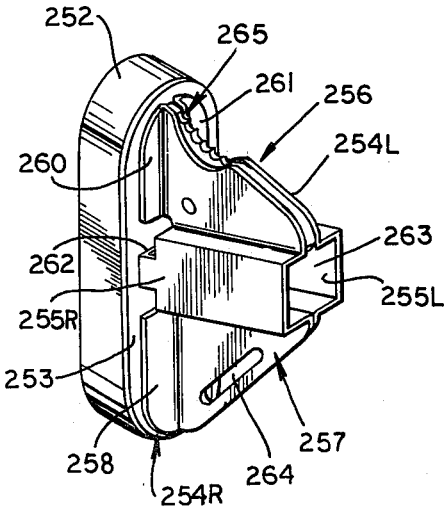
FIG. 21 is a pictorial view of the buttplate assembly for the secondd embodiment.
Figure 22:
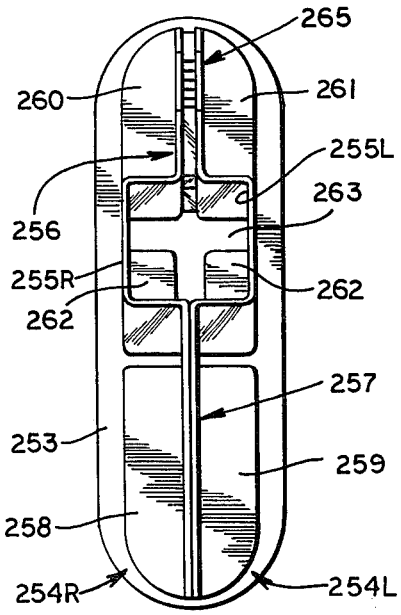
FIG. 22 is a front elevation view of the buttplate assembly shown in FIG. 21.

Although the centerfire embodiment has a stock tube 87' which is fabricated from hollow tube of square cross-section, similar to the rimfire embodiment, certain changes in the stock and the cartridge magazine are desirable in view of the substantially greater recoil forces caused by more powerful centerfire ammunition. Referring to FIGS. 18, 21, and 22, it is seen that the buttplate 250 is removably attached to the back end 251 of the stock tube. The buttplate 250 includes a recoil pad 252 made of a suitable resilient material such as rubber or the like, secured to the pad support plate 253 which forms part of the butt plate.

The butt plate 250 is preferably formed as a weldment of left and right side members 254L and 254R, respectively, as best shown in FIGS. 21 and 22. The weldment members include opposed channels 255L and 255R which fit together to form the socket 263 for receiving the back end 251 of the stock tube 87'. The side members 254L and 254R also form upper and lower triangular supports 256 and 257 which strengthen the buttplate. Tabs 258, 259 and 260, 261 are bent outwardly from the lower and upper triangular support members 257 and 256, and the tabs are secured to the plate 253 by spot-welding or the like. Tabs 262 at the bottom of the channels 255 are bent inwardly, due to space limitations at the back plate 253 outside of the channels, and are similarly secured to the back plate. A slot 264 is provided in the lower triangular support 257 to provide a rear attachment for a sling, if desired. A front attachment for a sling may be of conventional design and is not shown herein.

A catch assembly for securing the butt plate 250 to the stock tube 87' is provided by the catch member 265 which is received within a spaced-apart portion of the weldment which defines the upper triangular support 256. The catch member 265 is pivotally mounted by a pin 266 which extends through the catch member and through the upper triangular support 256 adjacent its base, and the catch member is urged forwardly by a spring 267 disposed between the back plate 253 and the back of the catch member. A finger 269 is located at the lower forward portion of the catch member 265 in position to engage an opening 268 formed in the top surface of the stock tube 87', when the back end 251 of the stock tube is fully inserted within the socket 263.

Figure 19:
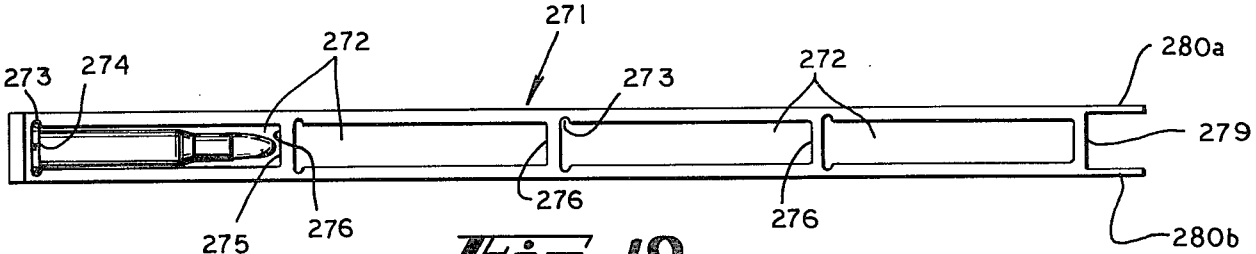
FIG. 19 is a top plan view of the cartridge carrier forming part of the second embodiment.

The cartridge magazine for the disclosed centerfire embodiment is provided by a separate cartridge carrier 271, FIGS. 18 and 19, which is configured to be slidably received within the hollow stock tube 87' when the butt plate 250 is removed from the back end of the stock tube. The cartridge carrier 271 has a plurality of separate cartridge receptacles 272, and the back end of each receptacle is notched as shown at 273 to accommodate the rim 274 of a typical cartridge. The length of each receptacle 272 is chosen so that a small space 275 exists between the nose of each cartridge and the front wall 276 of the receptacle. With each cartridge retained by the notch 273 from forward movement, the relatively soft nose of each cartridge in the cartridge carrier 271 is thus prevented from forceably contacting anything, such as the front wall 276 or the rim of the adjacent cartridge, in response to the relatively heavy recoil of the rifle. It is this need to prevent damaging the cartridge nose which makes impractical the use of a tubular magazine as previously described for the rimfire embodiment.

Extending forwardly from the front end 279 of the cartridge carrier 271 is a pair of fingers **280*a* and 280*b* which form no useful function for the cartridge carrier per se, but which assist in assembling the stock assembly 22' as illustrated in FIG. 20. The receiver assembly 78' is attached to the stock tube 87' by inserting upwardly through a slot 132' in the underside of the stock tube, as previously described for the rimfire embodiment. At this point in the assembly of the centerfire embodiment, the cartridge carrier 271 is inserted through the open back end 251 of the stock tube 87' and is moved forwardly therein to the position shown in FIG. 20, whereat the two fingers 280*a* and 280*b* at the front end 279 of the cartridge carrier contact the back end of the spring 151' and move that spring forwardly to clear the upper end 140' of the trigger member 137'. Once the receiver portion 78' is completely assembled within the stock tube 87', the cartridge carrier 271 is allowed to move rearwardly within the stock tube until the spring 151' contacts the forward surface 153' of the trigger member upper end. The cartridge carrier thereafter assumes its primary function of storing a supply of ammunition in the stock tube 87'**.

Although the present invention has been described with reference to two disclosed embodiments thereof, it will be apparent to those of ordinary skill in the art that numerous alterations and modifications may be made therein without departing from the spirit and the scope of the invention as defined in the following claims.

I claim:

1. Firearm apparatus which can assume either an assembled condition for loading and firing or a disassembled condition, comprising:

means comprising a barrel assembly;

means comprising a stock assembly;

means defining a hinge interconnection between said barrel assembly and said stock assembly, said hinge interconnection permitting relative movement of said assemblies between a closed position for firing, an open position for loading, and a takedown position which disconnects the two assemblies;

takedown catch means operatively associated with said barrel and stock assemblies and normally preventing movement of said assemblies to said takedown position, said takedown catch means being selectably operative to permit movement to said takedown position whereby the firearm apparatus are disassembled by disconnecting said two assemblies;

said barrel assembly comprising a barrel having a chamber end, and also comprising means at said chamber end defining the confronting sides of a receptacle which forms a portion of said hinge interconnection;

means at said chamber end defining an arc surface having a center point in said receptacle;

means in said receptacle to define a hinge pin at said center point;

means associated with said stock assembly defining a member which fits in said chamber end;

said member having means which pivotally receives said hinge pin;

said member having an arc surface which mates with said arc surface of said chamber end so as to retain said member in predetermined location between said chamber end and said hinge pin;

said hinge pin receiving means comprising a slot formed in said member in a plane perpendicular to the member;

said slot having a closed end comprising said hinge pin receiving means, and having an open end to receive said hinge pin;

said slot being located on said member to permit said hinge pin to move along said slot to said open end only when said barrel and stock assemblies are moved to said takedown position, whereat said arc surface of said member moves clear of said arc surface of said chamber end to allow separation of said assemblies;

extractor means carried by said member of said stock assembly and operative to engage and extract a cartridge from said chamber end of said barrel as said assemblies are moved from said closed position toward said open position; and means operative to withdraw said extractor means from said cartridge engagement in response to a predetermined extent of said movement toward said open position.

2. Firearm apparatus as in claim 1, wherein said means operative to withdraw said extractor means comprises a cam on said extractor means in position to engage said barrel assembly in response to said predetermined extent of movement.

3. Firearm apparatus which can assume either an assembled condition for loading and firing or a disassembled condition, comprising:

means comprising a barrel assembly;

means comprising a stock assembly;

means defining a hinge interconnection between said barrel assembly and said stock assembly, said hinge interconnection permitting relative movement of said asemblies between a closed position for firing, an open position for loading, and a takedown position which disconnects the two assemblies;

takedown catch means operatively associated with said barrel and stock assemblies and normally preventing movement of said assemblies to said takedown position, said takedown catch means being selectably operative to permit movement to said takedown position whereby the firearm apparatus are disassembled by disconnecting said two assemblies;

said takedown catch means comprising:

means defining a stop surface on one of said barrel and stock assemblies beneath said hinge interconnection;

a stop member mounted on the other of said assemblies beneath said hinge connection;

said stop member normally occupying a first position which abuts said stop surface and prevents further relative movement of said assemblies when said open position is reached;

said stop member being resiliently movable to a second position whereat said stop member bypasses said stop surface means to permit further relative movement to said takedown position and resiliently returns to said first position to abut said stop surface when said assemblies are returned to said open position;

said barrel assembly comprising a barrel having a chamber end, and also comprising a pair of side plates secured in mutually confronting relation alongside said barrel at the chamber end thereof;

said side plates having portions in predetermined mutually spaced apart relation below said chamber end;

said stop member being retained between said side plates below said chamber end, and having a stop engaging surface facing rearwardly toward said stock assembly; and said means defining a stop surface being disposed on said stock assembly.

4. Firearm apparatus as in claim 3, wherein said stop member comprises a cantilever spring secured between said side plates and having a cantilever portion extending rearwardly from said securement to terminate in said stop engaging surface, whereby said cantilever portion normally assumes said first position and can be resiliently moved downwardly to assume said second position.

5. Firearm apparatus which can assume either an assembled condition for loading and firing or a disassembled condition, comprising:

means comprising a barrel assembly;

means comprising a stock assembly;

means defining a hinge interconnection between said barrel assembly and said stock assembly, said hinge interconnection permitting relative movement of said assemblies between a closed position for firing, an open position for loading, and a takedown position which disconnects the two assemblies;

takedown catch means operatively associated with said barrel and stock assemblies and normally preventing movement of said assemblies to said takedown position, said takedown catch means being selectably operative to permit movement to said takedown position whereby the firearm apparatus are disassembled by disconnecting said two assemblies;

means on said barrel assembly comprising a sight, and having a latch portion extending from said sight toward said stock assembly;

said means on said barrel assembly comprising an elongate member having a front end and a back end, and secured intermediate its ends to said barrel assembly;

means at said front end forming said sight;

means at said back end defining at least one latching recess;

means on said stock assembly operative to engage said latch portion when said assemblies are moved to said closed position, so as to maintain said closed position;

said means on said stock assembly comprising at least one latch engaging member operative to enter and engage said latching recess when said assemblies are moved to said closed position; and said elongate member comprising a cantilever spring extending rearwardly from said intermediate securement so that said back end can be resiliently moved to selectably disengage said latching recess from said latch engaging member.

6. Firearm apparatus as in claim 5, wherein said latch engaging member includes a cam surface which engages and resiliently moves said back end of said elongate member to admit said latch engaging member to said latching recess as said assemblies move to said closed position.

7. Firearm apparatus which can assume either an assembled condition for loading and firing or a disassembled condition, comprising:

means comprising a barrel assembly;

means comprising a stock assembly;

means defining a hinge interconnection between said barrel assembly and said stock assembly, said hinge interconnection permitting relative movement of said assemblies between a closed position for firing, an open position for loading, and a takedown position which disconnects the two assemblies, and takedown catch means operatively associated with said barrel and stock assemblies and normally preventing movement of said assemblies to said takedown position, said takedown catch means being selectably operative to permit movement to said takedown position whereby the firearm apparatus are disassembled by disconnecting said two assemblies;

said stock assembly comprising a receiver portion including a plurality of plates sandwiched together in assembly;

stock means connected to said receiver portion and extending rearwardly therefrom to terminate at a back end; and shoulder engaging means at said back end of said stock means.

8. Firearm apparatus as in claim 7, wherein:

said plurality of plates comprises a pair of outside plates and an intermediate plate retained between said outside plates;

said intermediate plate having a portion cut away relative to the corresponding area of said outside plates, so that said cut away portion provides a recess between said outside plates; and extractor means disposed in said recess and operative to engage and extract a cartridge casing from said barrel assembly as said assemblies are moved from said closed position to said open position.

9. Apparatus as in claim 8, wherein said extractor means includes a cam which operatively coacts with said barrel assembly to retract said extractor means from said cartridge casing engagement as said assemblies are moved toward said open position, so that said extractor means remains retracted for reloading in said open position.

10. Firearm apparatus as in claim 7, wherein:

said plurality of plates comprises a pair of outside plates each of which has a barrel assembly engaging portion, said portions in assembly comprising a member which is part of said hinge interconnection means;

said member having a slot formed therein in a plane perpendicular to said plates; and said slot has an open end configured to admit a hinge pin of said barrel assembly, and a closed end configured to receive the hinge pin, so that said barrel and stock assemblies can be disassembled by withdrawing the hinge pin from the open end of said slot when in said takedown position.

11. Firearm apparatus as in claim 10, wherein:

said barrel assembly engaging portions have arc surfaces which mate with corresponding surfaces of said barrel assembly, so as to maintain said receiver portion in predetermined location with respect to said barrel assembly.

12. Firearm apparatus as in claim 7; wherein:

said stock means comprises a hollow stock tube having a forward end; and further comprising:

trigger means having a first portion pivotally received within said stock tube at a location spaced backwardly from said forward end, and having a trigger extending downwardly from said stock tube;

hammer means slidably received within said stock tube in front of said first portion of said trigger means; and a compression spring disposed between said hammer means and said trigger means first portion in operative relation to urge said hammer means forward in said stock tube and to bias said trigger in opposition to the directgion of trigger pull.

13. Firearm apparatus as in claim 12, further comprising:

a sear engaging surface on said hammer means; and said trigger means having a sear member extending forwardly of said first portion to engage said sear engaging surface when said hammer is moved rearwardly to cocked position, whereat said sear member is urged to said sear engagement surface by said bias on said trigger means.

14. Apparatus as in claim 12, wherein:

said hammer means is movable within said stock tube to a cocked position; and further comprising:

an aperture formed in said stock tube in proximate relation to said cocked position of said hammer means; and a safety member carried by said hammer means and selectably movable to enter and engage said stock tube aperture, so as to provide a safety lock which prevents movement of said hammer means forward from said cocked position.

15. Apparatus as in claim 14, wherein:

said stock tube aperture defines an acute angle relative to said stock tube; and said safety member has an aperture engaging surface that mates with said acute angle aperture so as to inhibit withdrawal of said safety member from said aperture.

16. Apparatus as in claim 15, further comprising:

a charging handle movably connected to said hammer means and operative to move with said hammer to cocked position; and said safety member comprises a portion of said charging handle so that movement of said charging handle relative to said hammer means controls said safety lock.

17. Firearm apparatus as in claim 12, further comprising:

means at the forward end of said stock tube to limit the extent of forward movement of said hammer means; and means carried by said hammer means and configured to protrude in front of said forward movement limiting means when said hammer means is forwardmost, so as to provide a firing pin which engages the rim of a cartridge in said barrel means.

18. Firearm apparatus as in claim 17, wherein:

said forward motion limiting means has a front portion which defines a seat for the rim of said cartridge; and said means carried by said hammer means is bifurcated so as to protrude into said rim seat at two separate locations, thereby providing dual firing pins for engaging the cartridge rim.

19. Firearm apparatus as in claim 12, wherein:

said plurality of plates comprises a pair of outside plates and an intermediate plate retained between said outside plates; and further comprising:

a recess formed in said intermediate plate in front of said forward end of said stock tube, said recess having a rear opening facing said stock tube in operative relation for impingement by said hammer means and having a forward opening in operative relation with the primer of a cartridge in said barrel assembly when said assemblies are in said closed position; and firing pin means received within said recess;

said firing pin having a hammer surface which receives a blow from said hammer means through said rear opening, and having a primer engaging pin which extends through said forward opening to contact the cartridge primer in response to said hammer blow.

20. Firearm apparatus as in claim 19, wherein:

said firing pin means is enlarged relative to said rear and forward openings of said recess, and is somewhat thinner than said intermediate plate, so that said firing pin is retained within said recess by said outside plates in laterally surrounding relation to said recess.

21. Firearm apparatus which can assume either an assembled condition for loading and firing or a disassembled condition, comprising: means comprising a barrel assembly;

means comprising a stock assembly including a receiver portion and a hollow tubular stock extending rearwardly from said receiver portion;

a cartridge tray removably received in said tubular stock;

said cartridge tray having means to define a plurality of serially aligned receptacles, each of which has a forward end and can receive a round of ammunition;

means associated with each of said receptacles to prevent a cartridge therein from contacting the forward end of the receptacle;

means defining a hinge interconnection between said barrel assembly and said stock assembly, said hinge interconnection permitting relative movement of said assemblies between a closed position for firing, an open position for loading, and a takedown position which disconnects the two assemblies; and takedown catch means operatively associated with said barrel and stock assemblies and normally preventing movement of said assemblies to said takedown position, said takedown catch means being selectably operative to permit movement to said takedown position whereby the firearm apparatus are disassembled by disconnecting said two assemblies.

22. Firearm apparatus as in claim 21, wherein said stock assembly further comprises:

a trigger assembly which is receivable in said tubular stock in front of said cartridge tray;

a hammer spring which fits within said tubular stock in front of said trigger assembly, and which in assembly exerts force against said trigger assembly; and means extending in front of said cartridge tray to engage said hammer spring and move said hammer spring forwardly in said tubular stock when said cartridge tray is moved forwardly beyond a normal location within said tubular stock, so that said hammer spring is moved forwardly to permit insertion or removal of said trigger assembly.

23. Firearm apparatus as in claim 21, wherein said means associated with each receptacle comprises means to engage the rim of a cartridge disposed in the receptacle, so as to prevent the cartridge from moving forwardly into contact with the front wall of the receptacle.

24. Firearm apparatus which can assume either an assembled condition for loading and firing or a disassembled condition, comprising:

means comprising a barrel assembly;

means comprising a stock assembly;

means defining a hinge interconnection between said barrel assembly and said stock assembly, said hinge interconnection permitting relative movement of said assemblies between a closed position for firing, an open position for loading, and a takedown position which disconnects the two assemblies; and takedown catch means operatively associated with said barrel and stock assemblies and normally preventing movement of said assemblies to said takedown position, said takedown catch means being selectably operative to permit movement to said takedown position whereby the firearm apparatus are disassembled by disconnecting said two assemblies;

said stock assembly comprising a hollow stock tube having a front end in proximate relation to said barrel assembly and having a rear end;

buttplate means which removably attaches to said back end of said stock tube; and latch means which releasably retains said buttplate means in place on said stock tube;

said buttplate means comprising a pair of sheet metal side members each of which is bent to form a channel, said side members being assembled with said channels aligned in mutually confronting relation so as to define a receptacle which receives said back end of said stock tube;

said latch means having a portion operatively associated with said receptacle to engage and retain said stock tube therein; and force absorbent means connected to said side members in rearwardly facing relation thereto, so as to form a recoil pad to place against the shoulder of a person who uses the firearm.

25. Firearm apparatus which can assume either a closed condition for firing or an open condition for loading and unloading, comprising:

means comprising a barrel assembly having a chamber end to receive a cartridge;

means comprising a stock assembly;

means defining a hinge interconnection between said barrel assembly and said stock assembly, said hinge interconnection permitting relative movement of said assemblies between a closed position for firing, and an open position for loading;

extractor means carried by said stock assembly and operative to engage and extract a cartridge casing from said chamber end of said barrel assembly as said assemblies are moved from said closed position toward said open position; and means operative to withdraw said extractor means from said cartridge casing engagement in response to a predetermined extent of said movement toward said open position, so that said extractor means remains withdrawn to permit reloading in said open position.

26. Firearm apparatus as in claim 25, wherein said means operative to withdraw said extractor means comprises a cam on said extractor means in position to engage said barrel assembly in response to said predetermined extent of movement.

27. Firearm apparatus which can assure either a closed condition for firing or an open condition for loading and unloading, comprising:

means comprising a barrel assembly having a chamber end to receive a cartridge;

means comprising a stock assembly;

means defining a hinge interconnection between said barrel assembly and said stock assembly, said hinge interconnection permitting relative movement of said assemblies between a closed position for firing, and an open position for loading;

said stock assembly comprising a receiver portion including a pair of outside plates and an intermediate plate retained in sandwiched assembly between said outside plates;

said intermediate plate having a portion cut away relative to the corresponding area of said outside plates, so that said cut away portion provides a recess between said outside plates; and extractor means disposed in said recess and operative to engage and extract a cartridge casing from said barrel assembly as said assemblies are moved from said closed position to said open position.

28. Apparatus as in claim 27, wherein said extractor means includes a cam which operatively coacts with said barrel assembly to retract said extractor means from said cartridge casing engagement as said assemblies are moved toward said open position, so that said extractor means remains retracted for reloading in said open position.

29. Firearm apparatus comprising:

a barrel assembly;

a stock assembly;

said stock assembly includes a hollow tubular passage having inner length and internal dimension adequate to receive plural rounds of ammunition in serial configuration;

an opening in the underside of said tubular stock passage intermediate the ends thereof to insert or remove said rounds;

the length of said opening being only slightly longer than the length of a round of said ammunition, so that the ammunition can fall from the opening one round at a time;

a gate member slidably received in said tubular stock passage in proximate relation to said opening;

means normally biasing said member to a position which blocks said opening; and a gate operating member extending laterally outwardly through the side of said stock and operative from outside said stock to slide said member rearwardly so as to unblock said opening, thereby enabling ammunition to be loaded or unloaded one round at a time.

30. Firearm apparatus as in claim 29, wherein:

said stock assembly comprises a receiver portion and a hollow tubular stock extending rearwardly from said receiver portion;

the interior of said hollow tubular stock comprising said ammunition receiving passage, and said opening being in the underside of said tubular stock;

an actuating slot formed in at least one side of said tubular stock; and said gate operating member extending outwardly through said actuating slot for normal operation to open said gate member, so that a person can manipulate said gate operating member with one hand to open the gate member and with the same hand receive the round of ammunition falling through said opening.

* * * * *